US008683719B2

(12) United States Patent
Chen

(10) Patent No.: US 8,683,719 B2
(45) Date of Patent: Apr. 1, 2014

(54) LED ILLUMINATION FOOTWEAR

(75) Inventor: Johnson Chen, Dongguan (CN)

(73) Assignee: Modit Footwear Corp., City of Industry, CA (US)

( * ) Notice: Subject to any disclaimer, the term of this patent is extended or adjusted under 35 U.S.C. 154(b) by 173 days.

(21) Appl. No.: 13/385,998

(22) Filed: Mar. 19, 2012

(65) Prior Publication Data

US 2013/0239441 A1 Sep. 19, 2013

(51) Int. Cl.
*A43B 23/24* (2006.01)

(52) U.S. Cl.
USPC ..... 36/137; 36/136; 36/11.5; 362/103

(58) Field of Classification Search
USPC ..... 36/136, 137, 11.5, 141; 362/103; 601/30, 46
See application file for complete search history.

(56) References Cited

U.S. PATENT DOCUMENTS

| | | | | |
|---|---|---|---|---|
| 5,052,131 | A * | 10/1991 | Rondini | 36/137 |
| 8,327,561 | B1 * | 12/2012 | Smith, III | 36/137 |
| 2005/0018417 | A1 * | 1/2005 | Chien | 362/103 |
| 2010/0170115 | A1 * | 7/2010 | Smith, III | 36/137 |

* cited by examiner

*Primary Examiner* — Khoa Huynh
*Assistant Examiner* — Katherine Gracz
(74) *Attorney, Agent, or Firm* — Raymond Y. Chan; David and Raymond Patent Firm

(57) ABSTRACT

A sandal includes a footwear body, one affixing strap and an illumination arrangement. The footwear body has top surface, a bottom surface, and a plurality of light cavities formed on the top surface of the footwear body. The affixing strap has a plurality of light admissible end portions and a body portion extended between the light admissible end portions, wherein the light admissible end portions are mounted in the light cavities respectively. The illumination arrangement is provided in the footwear body, and includes a plurality of illumination units mounted in the light cavities of the footwear body to generate illumination toward the light admissible end portions of the affixing strap respectively for illuminating the sandal in a predetermined illumination pattern.

22 Claims, 4 Drawing Sheets

LED ILLUMINATION FOOTWEAR

BACKGROUND OF THE PRESENT INVENTION

1. Field of Invention

The present invention relates to a footwear article, and more particularly to a sandal comprising an illumination arrangement which is capable of providing illumination to at least a light admissible end portion of an affixing strap.

2. Description of Related Arts

A conventional footwear article, such as a sandal, usually comprises a main body shafted and crafted as a sole and a securing strap attached on the main body, wherein a user's foot is adapted to step on the main body. The gap between the big toe and the second toe is for clamping the securing strap so as to allow the user walks with the sandal. For this type of sandal, the securing strap usually has a plurality of curved and elongated holding strap portions and a thong extended from front ends of the holding strap portions for being accommodated in the gap between the first toe and the second toe.

On the other hand, some sandals do not require the wearer to hold the thong by the big toe and the second toe. Rather, the securing strap is extended from one side of the main body to another side to form a receiving cavity between an inner surface of the securing strap and a top surface of the main body, wherein a user is allowed to step on to the main body and put a front portion of his or her foot into the receiving cavity. The user is then able to walk with the sandal.

One disadvantage of the above-mentioned sandals is that they do not have illuminating devices provided thereon. One reason for this is that the construction of sandal is usually very simple, and it is difficult to one to put an illuminating device on the sandal without involving complicated electrical components. Moreover, unlike conventional shoes, there exists limited space on a traditional sandal for one to implement illuminating device. For example, it is extremely difficult for one to illuminate the entire securing strap without actually mounting illuminating LEDs thereonto. However, mounting LEDs onto the securing strap will severely affect the aesthetic appearance of the sandal and this makes any resulting sandal unpopular.

SUMMARY OF THE PRESENT INVENTION

The invention is advantageous in that it provide a footwear article such as a sandal comprising an illumination arrangement which is capable of providing illumination to at least a light admissible end portion of an affixing strap.

Another advantage of the invention is to provide a footwear article such as a sandal comprising an illumination arrangement, which is capable of illuminating the entire affixing strap without attaching illuminating LEDs onto the affixing strap.

Another advantage of the invention is to provide a footwear article such as a sandal comprising an illumination arrangement, wherein the electrical components of the illumination arrangement can be embedded in the sandal's main body (i.e. the sole) so as not to affect the normal aesthetic appearance of the sandal. In fact, the illumination arrangement increases the aesthetic appearance of the sandal by providing desirable illumination.

Another advantage of the invention is to provide a footwear article such as a sandal comprising an illumination arrangement which is capable of providing a wide variety of illumination effects for the affixing strap.

Another advantage of the invention is to provide an illumination device for a footwear article comprising an affixing strap, wherein the illumination device is capable of providing illumination to at least a light admissible end portion of an affixing strap so as to provide a desirable illumination effect to the shoe as a whole.

Additional advantages and features of the invention will become apparent from the description which follows, and may be realized by means of the instrumentalities and combinations particular point out in the appended claims.

According to the present invention, the foregoing and other objects and advantages are attained by providing a footwear article, comprising:

a footwear body having top surface, a bottom surface, and a plurality of light cavities formed on the top surface of the footwear body;

at least one affixing strap having a plurality of light admissible end portions and a body portion extended between the light admissible end portions, wherein the light admissible end portions are mounted in the light cavities respectively; and an illumination arrangement provided in the footwear body, and comprises a plurality of illumination units mounted in the light cavities of the footwear body to generate illumination toward the light admissible end portions of the affixing strap respectively for illuminating the sandal in a predetermined illumination pattern.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
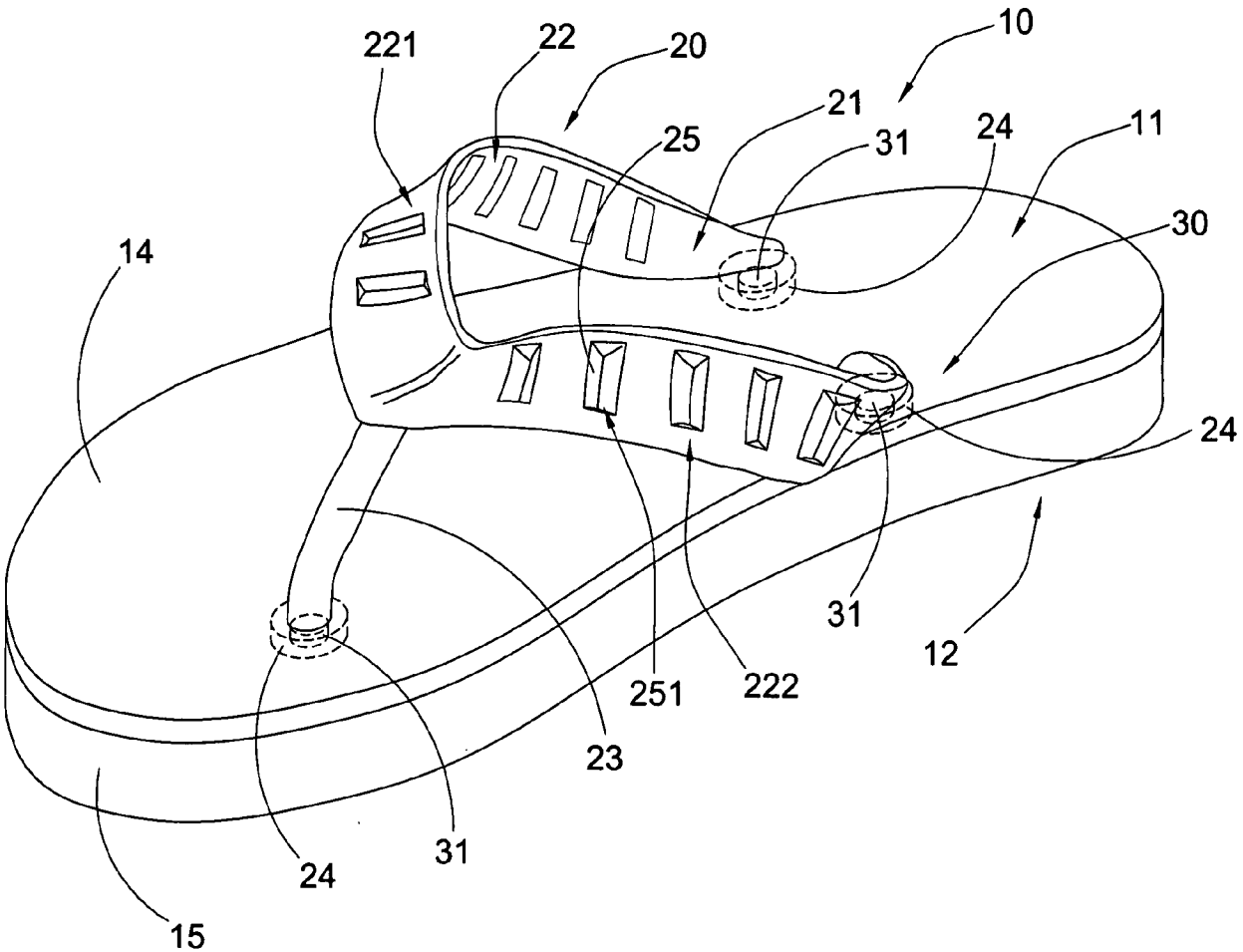
FIG. 1 is a perspective view of a footwear article according to a preferred embodiment of the present invention.
Figure 2:
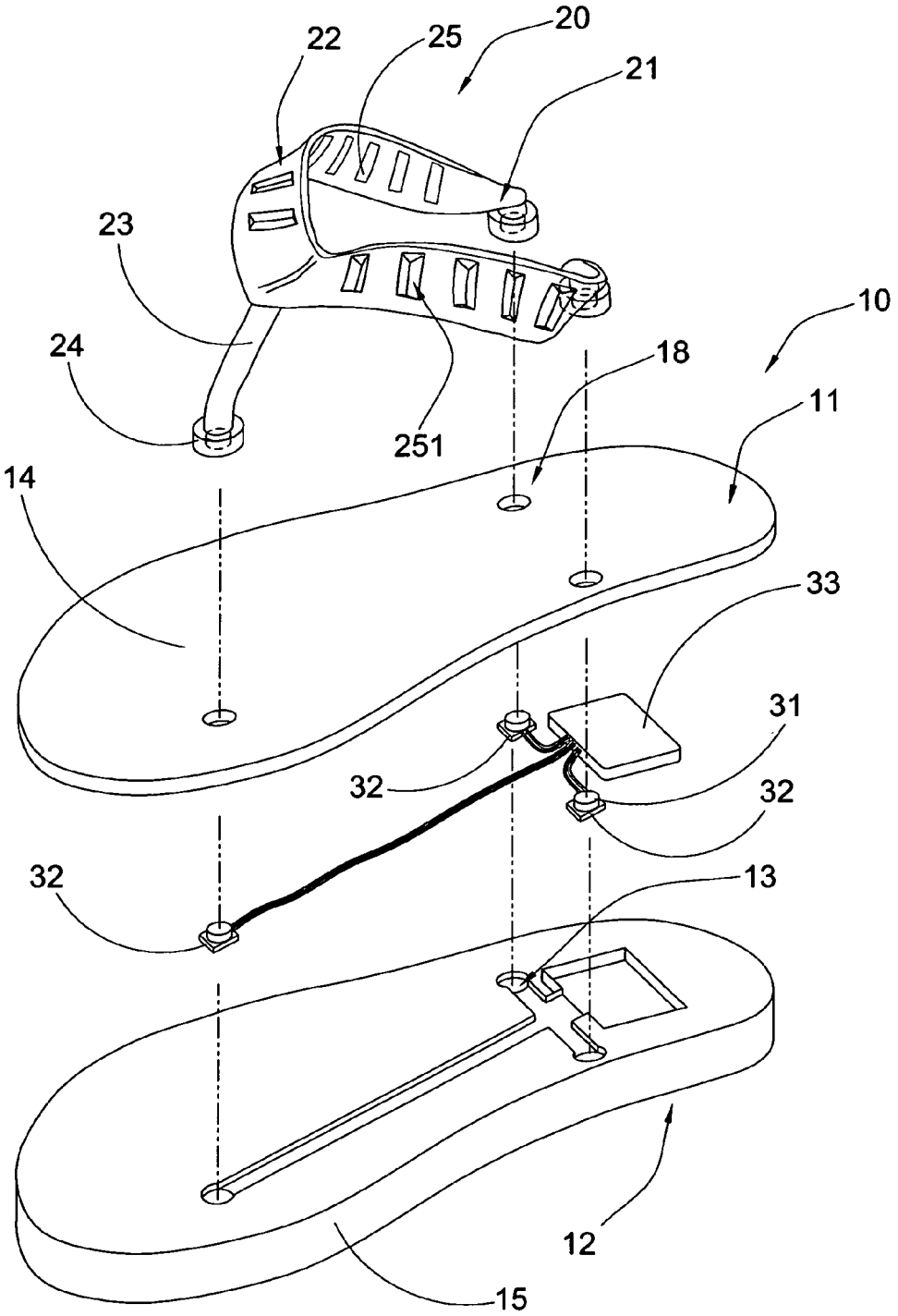
FIG. 2 is an exploded perspective view of the footwear article according to the above preferred embodiment of the present invention.
Figure 3:
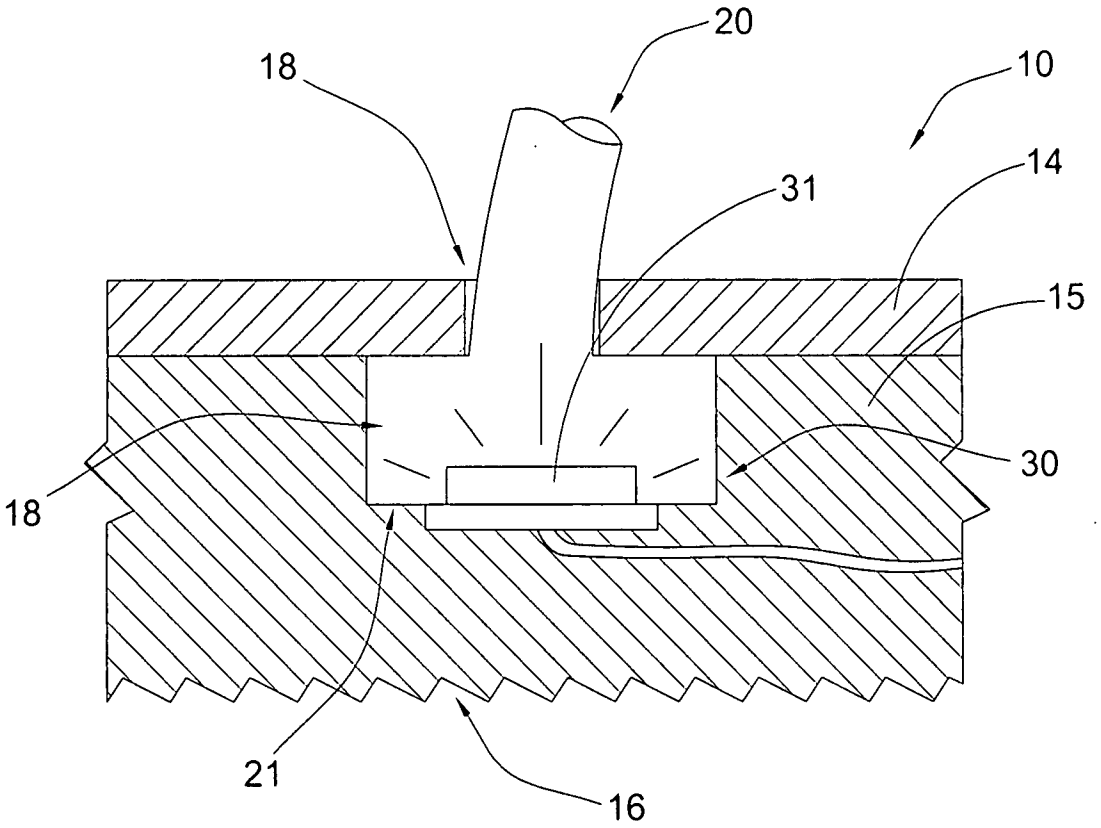
FIG. 3 is a sectional side view of the footwear article according to the above preferred embodiment of the present invention.

Referring to FIG. 1 to FIG. 3 of the drawings, a footwear article, such as a sandal, according to a preferred embodiment of the present invention is illustrated, in which the sandal comprises a footwear body 10, at least one affixing strap 20, and an illumination arrangement 30.

The footwear body 10 has a top surface 11, a bottom surface 12, and a plurality of light cavities 13 formed on the top surface 11 of the footwear body 10. The footwear body 10 is embodied as the sole of the sandal so that the user is arranged to step on the top surface 11 of the footwear body 10 for wearing on the sandal.

On the other hand, the affixing strap 20 has a plurality of light admissible end portions 21 and a body portion 22 extended between the light admissible end portions 21, wherein the light admissible end portions 21 are mounted in the light cavities 13 of the footwear body 10 respectively.

The illumination arrangement 30 is provided in the footwear body 10, and comprises a plurality of illumination units 31 mounted in the light cavities 13 of the footwear body 10 to generate illumination toward the light admissible end portions 21 of the affixing strap 20 respectively for illuminating the sandal in a predetermined illumination pattern.

According to the preferred embodiment of the present invention, the footwear body 10 is made of durable rubber material and has a contour resembling a shape of a human's foot so as to constitute the sole of the sandal. Moreover, the footwear body 10 comprises an upper sole member 14 and a lower sole member 15 overlappedly attached o on the upper sole member 14, wherein the top surface 11 of the footwear body 10 is formed as the top surface of the upper sole member 14 for allowing a user to step thereon, while the bottom surface 12 is formed as the bottom surface of the lower sole member 15 for contacting the ground surface while the sandal is worn by the user. Thus, the footwear body 10 further has a plurality of frictional grooves 16 indently formed on the bottom surface 12 so as to increase a friction of the bottom surface 12 for preventing accidental slipping by the user wearing the sandal.

The affixing strap 20 further comprises a holding thong 23 extended from the body portion 22 to the corresponding light cavity 13 of formed on the footwear body 10. The body portion 22 of the affixing strap 20 has a first and a second strap section 221, 222 from the top surface 11 of the footwear body 10 so as to form a substantially V-shaped cross section of the affixing strap 20. Moreover, each of the first strap section 221 and the second strap section 222 is slightly twisted so as to generate a predetermined aesthetical illuminating pattern of the affixing strap 20.

Note also that the light admissible end portions 21 of the affixing strap 20 are formed as the lower end portions of the first strap section 221 and the second strap section 222 respectively, so that each of the first strap section 221 and the second strap section 222 is upwardly and inclinedly extended from the top surface 11 of the footwear body 10, wherein the holding thong 23 is extended between an intersection of the first strap section 221 and the second strap section 222 and the top surface 11 of the footwear body 10.

In order to affix the affixing strap 20 and the holding thong 23 onto the footwear body 10, the footwear body 10 further has a plurality of affixing openings 18 formed on the top surface 11 of the footwear body 10 to communicate with the light cavities 13 with an exterior of the footwear body 10 respectively, a cross sectional area of each of the affixing openings 18 is smaller than that the corresponding light cavity 13. On the other hand, the affixing strap 20 further comprises a plurality of affixing members 24 integrally formed on the light admissible end portions 21 and a lower end portion of the holding thong 23 respectively, wherein a cross sectional sizes of the affixing members 24 are substantially the same as the light cavities 13 respectively but smaller than the corresponding affixing openings 18 so that when the affixing members 24 are accommodated in the light cavities 13, they are prevented from detaching from the light cavities 13 due to the difference in cross sectional area between the affixing member 24 and the corresponding affixing opening 18.

It is worth mentioning that the affixing members 24 are also made of light admissible material such as transparent rubber material so that light from the illumination units 31 are capable of reaching an exterior of the footwear body 10 through the affixing members 24 and the light admissible end portions 21 of the affixing strap 20.

As shown in FIG. 2, FIG. 3 of the drawings, the illumination units 31 of the illumination arrangement 30 is embedded in the affixing members 24 respectively in such a manner that the light generated by the illumination units 31 can reach an exterior of the footwear body 10 through the affixing members 24 and the affixing openings 18. Moreover, each of the illumination units 31 is arranged to generate illumination of predetermined color so that the sandal is capable of producing different lighting effects.

The illumination arrangement 30 further comprises at least one central processing circuitry 32 mounted in the footwear body 10 and is electrically connected to the illumination units 31 for controlling the illumination units 31 to generate illumination in a predetermined pattern.

Moreover, the illumination arrangement 30 further comprises a vibration sensor 33 provided in the footwear body 10 and is electrically connected to the central processing circuitry 32 in such a manner that when the vibration sensor 33 has detected a vibration or impact, the vibration sensor 33 is arranged to send a corresponding signal to the central processing circuitry 32 which is then arranged to trigger the illumination units 31 to generate a predetermined illumination pattern. This illumination pattern is pre-programmed in the central processing circuitry 32 and therefore can be altered or amended according to manufacturing needs. Preferably, the vibration sensor 33 is embedded in a rear portion of the footwear body so that when that portion is subject to impacts or vibrations, such as those produced by walking, the vibration sensor 33 will be triggered to signal the central processing circuitry 32 to produce the predetermined pattern of illumination by the illumination units 31.

In order to provide electrical energy to the illumination arrangement 30, the illumination arrangement 30 further comprises a battery embedded in the footwear body 10 and is electrically connected to the central processing circuitry 32, which is arranged to act as a power source for transmitting electrical power to the illumination units 31.

At this point, it is important to mention that the affixing strap 20 may also assist in producing different lighting effects. For example, the body portion 20 of the affixing strap 20 is made of transparent material so that the illumination generated by the illumination units 31 can pass through the affixing strap 20 for forming an illuminating strap. In order to further enhance a lighting effect of the sandal, the affixing strap 20 further comprises a plurality of reflective elements 25 spacedly formed thereon, wherein the reflective elements 25 is arranged to reflect illumination generated by the illumination units 31 for providing a predetermined reflective lighting effect of the sandal of the present invention.

The reflective elements 25 may be embedded and spacedly provided within the affixing strap 20 so as to prevent the wearer of the sandal from touching the reflective elements 25 and imparting any uncomfortable feeling to the wearer. Alternatively, the reflective elements 25 may be formed by making a slot or indention 251 on the affixing strap 20 so as to alter a reflective property of the affixing strap 20 at particular areas thereof. It is important to mention that the slot or indention 251 of the reflective elements 25 may form a wide variety of cross sectional shapes, such as rectangular shape, square shape, heart shape, rhombus shape or any other cross sectional shape.

It is worth mentioning that the present invention also cover shoes in general as long as the shoe comprises the affixing strap 20. Thus, it should be borne in mind that the present invention covers sandals as well as any kind of shoes as long as the shoes comprise the affixing straps 20.

Figure 4:
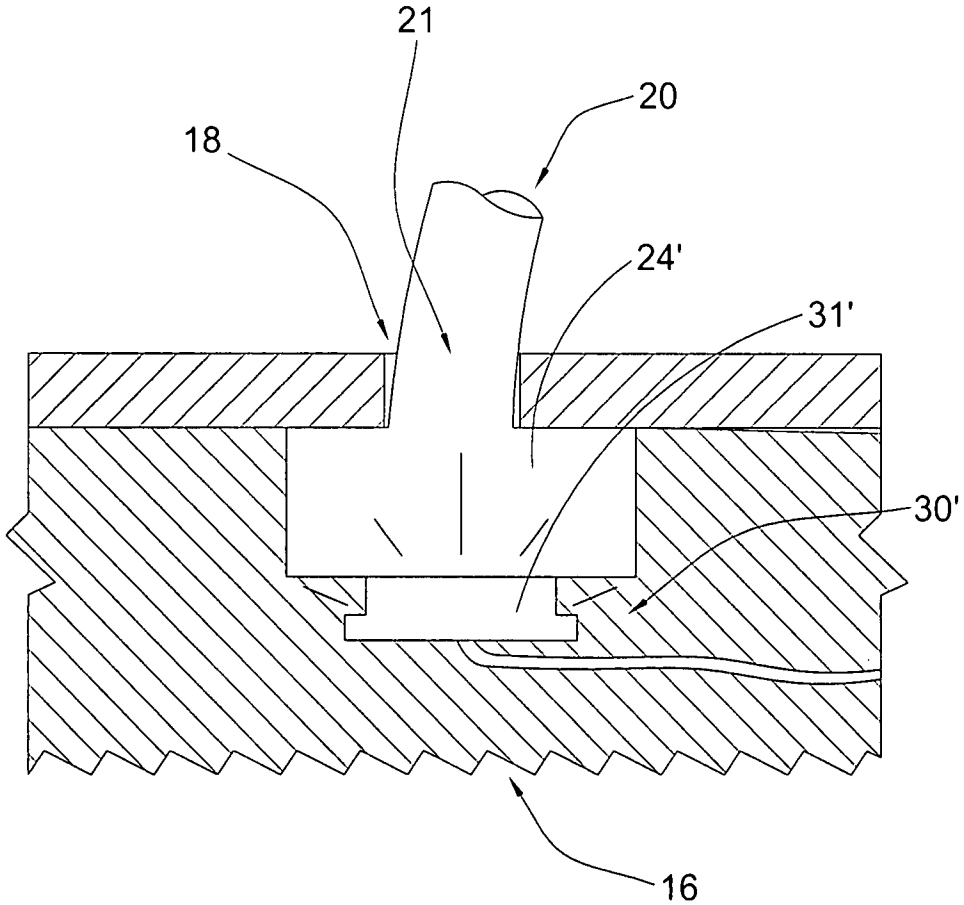
FIG. 4 is a first alternative mode of the footwear article according to the above preferred embodiment of the present invention.

Referring to FIG. 4 of the drawings, a first alternative mode of the sandal according present invention is illustrated. The first alternative mode is similar to the preferred embodiment except the illumination arrangement 30'. According to the alternative mode, the illumination units 31' are mounted in the light cavities 13" respectively but they are not embedded by the affixing member 24'. In other words, the illumination units 31' are mounted in the light cavities 13' at a position underneath the corresponding affixing member 24', wherein the illumination generated by the illumination units 31' are arranged to reach an exterior of the footwear body 10' through the affixing members 24' and the light admissible end portions 21 of the affixing strap 20'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A footwear article, comprising:

a footwear body having top surface, a bottom surface, and a plurality of light cavities formed on said top surface of said footwear body;

at least one affixing strap having a plurality of light admissible end portions and a body portion extended between said light admissible end portions, wherein said light admissible end portions are mounted in said light cavities respectively, wherein said affixing strap further comprises a plurality of reflective elements spacedly formed thereon;

an illumination arrangement provided in said footwear body, and comprises a plurality of illumination units mounted in said light cavities of said footwear body to generate illumination toward said light admissible end portions of said affixing strap respectively for illuminating said footwear article in a predetermined illumination pattern, wherein said reflective elements are arranged to reflect illumination generated by said illumination units for providing a predetermined reflective lighting effect; wherein said affixing strap further comprises a holding thong extended from said body portion to said corresponding light cavity formed on said footwear body, wherein said body portion of said affixing strap has a first and a second strap section from said top surface of said footwear body so to as to form a substantially V-shaped cross section of said affixing strap; and wherein said light admissible end portions of said affixing strap are formed as lower end portions of said first strap section and said second strap section respectively, so that each of said first strap section and said second strap section is upwardly and inclinedly extended from said top surface of said footwear body, wherein said holding thong is extended between an intersection of said first strap section and said second strap section and said top surface of said footwear body.

2. The footwear article, as recited in claim 1, wherein said footwear body further has a plurality of affixing openings formed on said top surface of said footwear body to communicate with said light cavities with an exterior of said footwear body respectively, wherein a cross sectional area of each of said affixing openings is smaller than that said corresponding light cavity, wherein said affixing strap further comprises a plurality of affixing members integrally formed on said light admissible end portions and a lower end portion of said holding thong respectively, wherein a cross sectional sizes of said affixing members are substantially the same as said light cavities respectively but smaller than that of said corresponding affixing openings so that when said affixing members are accommodated in said light cavities, said affixing members are prevented from detaching from said light cavities.

3. The footwear article, as recited in claim 2, wherein said illumination units of said illumination arrangement are embedded in said affixing members respectively in such a manner that said light generated by said illumination units is capable of reaching an exterior of said footwear body through said affixing members and said affixing openings.

4. The footwear article, as recited in claim 3, wherein said illumination arrangement further comprises a central processing circuitry mounted in said footwear body and is electrically connected to said illumination units for controlling said illumination units to generate illumination in a predetermined pattern.

5. The footwear article, as recited in claim 4, wherein said illumination arrangement further comprises a vibration sensor provided in said footwear body and is electrically connected to said central processing circuitry in such a manner that when said vibration sensor has detected a vibration or impact, said vibration sensor is arranged to send a corresponding signal to said central processing circuitry which is arranged to trigger said illumination units to generate a predetermined illumination pattern.

6. The footwear article, as recited in claim 5, wherein said affixing members are also made of light admissible material so that light from said illumination units are capable of reaching an exterior of said footwear body through said affixing members and said light admissible end portions of said affixing strap.

7. The footwear article, as recited in claim 6, wherein said body portion of said affixing strap is made of light admissible material so that said illumination generated by said illumination units is capable of passing through said affixing.

8. The footwear article, as recited in claim 7, wherein each of said reflective elements is embodied as an indention formed on said affixing strap for reflecting illumination generated by said illumination units for providing a predetermined reflective lighting effect.

9. The footwear article, as recited in claim 8, wherein said illumination arrangement further comprises a battery embedded in said footwear body and is electrically connected to said central processing circuitry, which is arranged to transmit electrical power to said illumination units.

10. The footwear article, as recited in claim 9, wherein each of said first strap section and said second strap section is slightly twisted so as to generate a predetermined aesthetical illuminating pattern of said affixing strap.

11. The footwear article, as recited in claim 10, wherein said vibration sensor is embedded in a rear portion of said footwear body.

12. The footwear article, as recited in claim 11, wherein said footwear body comprises an upper sole member and a lower sole member overlappedly attached on said upper sole member, wherein said top surface of said footwear body is formed as said top surface of said upper sole member for allowing a user to step thereon, while said bottom surface is formed as said bottom surface of said lower sole member for contacting a ground surface while said footwear is worn by a user.

13. The footwear article, as recited in claim 2, wherein said illumination units are mounted in said light cavities respectively at a position underneath said corresponding affixing member, wherein said illumination generated by said illumination units are arranged to reach an exterior of said footwear body through said affixing members and said light admissible end portions of said affixing strap.

14. The footwear article, as recited in claim 13, wherein said illumination arrangement further comprises a central processing circuitry mounted in said footwear body and is electrically connected to said illumination units for controlling said illumination units to generate illumination in a predetermined pattern.

15. The footwear article, as recited in claim 14, wherein said illumination arrangement further comprises a vibration sensor provided in said footwear body and is electrically connected to said central processing circuitry in such a manner that when said vibration sensor has detected a vibration or impact, said vibration sensor is arranged to send a corresponding signal to said central processing circuitry which is arranged to trigger said illumination units to generate a predetermined illumination pattern.

16. The footwear article, as recited in claim 15, wherein said affixing members are also made of light admissible material so that light from said illumination units are capable of reaching an exterior of said footwear body through said affixing members and said light admissible end portions of said affixing strap.

17. The footwear article, as recited in claim 16, wherein said body portion of said affixing strap is made of light admissible material so that said illumination generated by said illumination units is capable of passing through said affixing.

18. The footwear article, as recited in claim 17, wherein said affixing strap further comprises a plurality of reflective elements spacedly formed thereon, wherein said reflective elements are arranged to reflect illumination generated by said illumination units for providing a predetermined reflective lighting effect.

19. The footwear article, as recited in claim 18, wherein said illumination arrangement further comprises a battery embedded in said footwear body and is electrically connected to said central processing circuitry, which is arranged to transmit electrical power to said illumination units.

20. The footwear article, as recited in claim 19, wherein each of said first strap section and said second strap section is slightly twisted so as to generate a predetermined aesthetical illuminating pattern of said affixing strap.

21. The footwear article, as recited in claim 20, wherein said vibration sensor is embedded in a rear portion of said footwear body.

22. The footwear article, as recited in claim 21, wherein said footwear body comprises an upper sole member and a lower sole member overlappedly attached on said upper sole member, wherein said top surface of said footwear body is formed as said top surface of said upper sole member for allowing a user to step thereon, while said bottom surface is formed as said bottom surface of said lower sole member for contacting a ground surface while said footwear is worn by a user.

* * * * *